United States Patent [19]

Boliver et al.

[11] 4,067,636

[45] Jan. 10, 1978

[54] ELECTRICAL SEPARABLE CONNECTOR WITH STRESS-GRADED INTERFACE

[75] Inventors: Vincent J. Boliver, Hackettstown; Henry N. Tachick, Blairstown, both of N.J.

[73] Assignee: General Electric Company, Philadelphia, Pa.

[21] Appl. No.: 716,131

[22] Filed: Aug. 20, 1976

[51] Int. Cl.[2] ..... H01B 17/76; H01B 17/44

[52] U.S. Cl. ..... 339/143 C; 174/73 SC; 174/142

[58] Field of Search ..... 339/143 R, 143 C, 111, 339/60, 61; 174/73 R, 73 SC, 140 R, 140 C, 4 L

[56] References Cited

U.S. PATENT DOCUMENTS

| | | | |
|---|---|---|---|
| 3,622,688 | 11/1971 | Link et al. | 339/143 C X |
| 3,725,846 | 4/1973 | Strain | 339/143 C X |

*Primary Examiner*—Gerald A. Dost
*Assistant Examiner*—E. F. Desmond
*Attorney, Agent, or Firm*—William Freedman; Francis X. Doyle; Carl L. Silverman

[57] ABSTRACT

A rod connector module of the type comprising an insulating housing containing a contact rod support, a receiving cone in the housing extending from the exterior toward the support, and a conductive contact rod fixed at one end to the support and extending toward the exterior along the axis of the well is provided with a layer of electrically resistive voltage stress grading material of the inside surface of the well and electrically connected to the supported end of the rod.

7 Claims, 1 Drawing Figure

ELECTRICAL SEPARABLE CONNECTOR WITH STRESS-GRADED INTERFACE

BACKGROUND OF THE INVENTION

The present invention relates to electrical separable connector modules for connecting together the operating components of an underground power distribution system by means of shielded electrical cable.

Separable connector assemblies for underground power distribution cable, or shielded cable, are watertight when assembled and may be readily separated into two or more units to break a cable connection. As such units are available separately commercially for various reasons and are individually subject to special design considerations, they are commonly referred to as "modules". Thus, a connection includes two or more matching modules assembled together.

One type of separable connector commonly used is known as a "rod and bore" type. A bore connector module having a receiving bore in a shielded, insulating housing and a grasping contact member in the bore receives a matching rod connector module having rod contact extending axially along a receiving passageway, or cone, in the rod housing for receiving the matching portion of the bore module. The rod is inserted in the bore and grasped by the bore contact member. Examples of this type of connector are described, for example, in the following U.S. Patents:

- U.S. Pat. No. 3,513,437 issued May 19, 1970 to W. A. Morris
- U.S. Pat. No. 3,542,986 issued Nov. 24, 1970 to E. J. Kotski
- U.S. Pat. No. 3,551,587 issued Dec. 29, 1970 to R. F. Propst
- U.S. Pat. No. 3,587,035 issued June 22, 1971 to E. J. Kotski, and
- U.S. Pat. No. 3,955,874 issued May 11, 1976 to V. J. Boliver.

A rod module generally has an elastomeric insulating housing with an outer conductive shield layer connected to ground. The housing has a cable entrance opening at one end through which a cable is electrically connected to an embedded crimp connector fixture. The fixture is surrounded by a conductive shielding insert layer of elastomer for assuring that there are no voids between the conductive internal components and the insulating housing material. The housing is additionally provided at another end with an elongated passageway extending from an open exterior end toward the fixture. A conductive contact rod is fixed at one end to the crimp fixture and extends along the axis of the passageway. The configuration of the passageway is that of a truncated circular cone segment tapering in toward the insert and therefore the passageway is commonly referred to as the "cone". The cone is adapted to receive a bore module housing portion of matched configuration with a receiving bore for guiding the contact rod to a set of female contacts. The exterior end of the well may additionally be provided with a short skirt of elastomer to prevent restrike to the ground shield through ionized gases generated by arcing in the bore when energized modules are disconnected.

It has been found that when such rod modules as described above are used for disconnecting energized cable of relatively high distribution voltages, such as, for example, 12 kilovolts and higher, an audible corona can arise inside the cone of the rod module after disconnection. This corona will in some cases result in a dielectric breakdown of the arc-generated gases in the cone and cause the rod contact to be short circuited to the grounded shield of the housing or other adjacent grounded surfaces.

SUMMARY OF THE INVENTION

The novel rod module is provided with a resistive stress relief layer on the inside surface of the cone and electrically connected to the rod.

The stress relief layer prevents corona and subsequent dielectric breakdown in the cone without otherwise interferring with the operation of the module.

The stress relief layer additionally reduces the likelihood of premature arcing between the rod and matching female contacts in the making of a connection on three-phase applications, in which there is a greater voltage between the rod and female contacts.

DESCRIPTION OF THE PREFERRED EMBODIMENT

Figure 1:
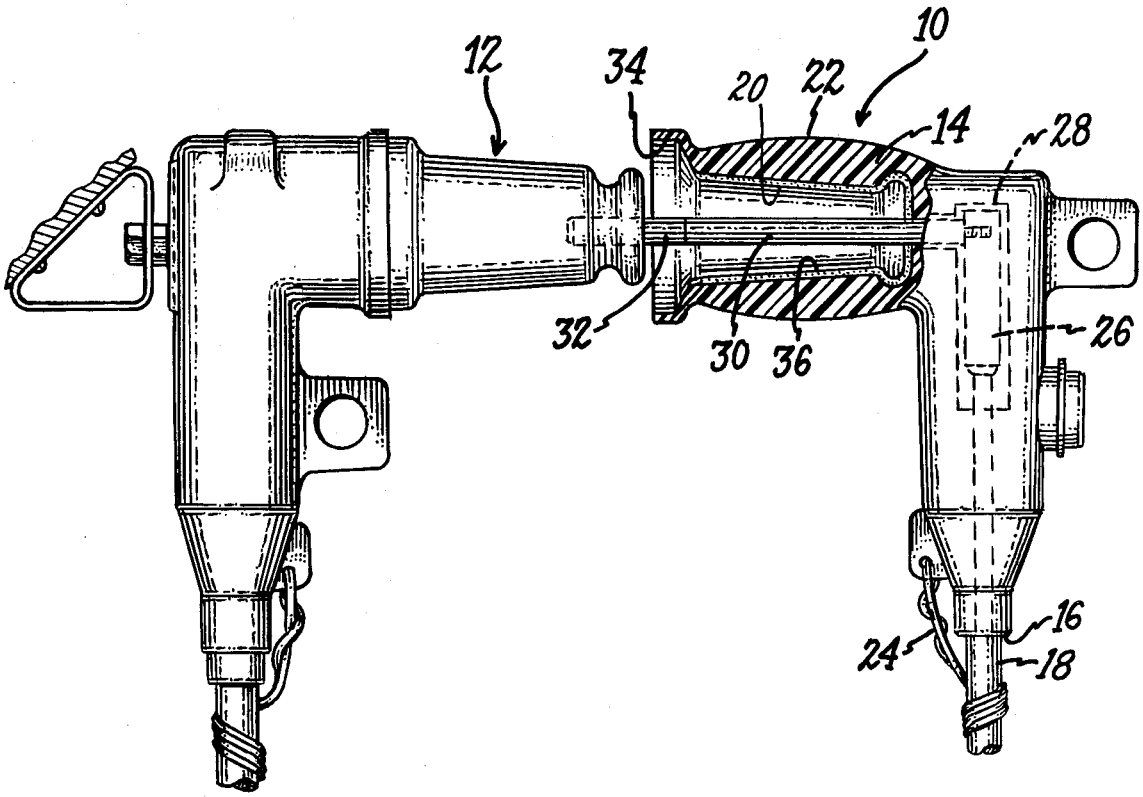
FIG. 1 is a partially-sectioned side view of a partially-engaged matching pair of separable connector modules in accordance with the preferred embodiment of the present invention.

A preferred embodiment of the present invention is the elbow type rod module 10 shown in FIG. 1 of the drawings in partial engagement with a matching bore module 12.

The rod module 10 has an elastomeric housing 14 with a cable entrance 16 at one end for a cable 18 and a cone 20 in another end. A conductive grounded shield layer 22 extends over most of the outer surface of the housing 14 and is connected by a lead 24 and the cable shielding to ground. A metal crimp fixture 26, shown in phantom lines is disposed inside the housing 14 and connected to the conductor of the cable 18. A conductive shield coating insert 28, also shown in phantom lines, surrounds the fixture 26.

Axially disposed in the cone 20 with one end rigidly attached to the fixture 26 is a metal contact rod 30 with an ablative follower 32. At the outer rim of the cone 20 is a gas shield 34.

The entire inside surface of the cone 20 is covered with a resistive stress relief layer 36 of carbon loaded elastomer having a thickness of about 1.25 millimeters to about 2 millimeters and a volume resistivity of about $3 \times 10^8$ ohm - centimeters. The layer 36 is electrically connected at the bottom of the cone 20 to the conductive shield insert 28 and thus also to the fixture 26.

The resistive layer 36 gradually attenuates the voltage along its axial length and thereby eliminates highly concentrated field stress which might generate corona.

GENERAL CONSIDERATIONS

The stress relief layer specifications may be varied within limits.

The layer must extend a certain minimum distance axially to be effective in reducing the field stress. As a practical matter, the minimum length should be at least about 3 centimeters for a connector rated at 8.3 kilovolts and should be greater for connectors of higher ratings.

The stress relief layer should also have a minimum total resistance at the operating voltage along its entire length of about 10 megohms. If the total resistance is too low, the stress which without the layer was concentrated in the bottom of the core will simply be moved to the outer end of the layer 36 to cause similar corona problems there.

If the resistance of the layer is too high, on the other hand, the stress grading effect of the layer will again be diminished since most of the voltage attenuation will be in that portion immediately adjacent the inner end of the rod. The total resistance of the layer along its axial length should therefore not be much greater than about 1000 megohms.

We claim:

1. A rod connector module for separably connecting shielded electrical power cable, said module comprising:

an insulating housing containing a contact rod support;

a receiving cone in said housing extending from exterior to said housing toward said support, and a conductive contact rod fixed at one end to said support and extending toward the exterior along the axis of said cone, wherein the improvement comprises a layer of electrically resistive voltage stress grading material on the inside surface of said cone and electrically connected to the supported end of said rod.

2. The module of claim 1 wherein said layer has an axial length of at least about 3 centimeters.

3. The module of claim 2 wherein the total axial resistance of said layer is on the order of about 10 megohms to about 1000 megohms.

4. The module of claim 3 wherein said layer covers said inside surface of said well along a major axial dimensional portion of said cone adjacent said supported end of said rod.

5. The module of claim 4 wherein said layer is of elastomer loaded with finely divided electrically conductive particles.

6. The module of claim 5 wherein said particles are carbon.

7. The module of claim 6 and wherein said layer has a thickness of between about 1.25 millimeters and about 2 millimeters.

* * * * *